US005872082A

United States Patent [19]

Watts et al.

[11] Patent Number: 5,872,082

[45] Date of Patent: Feb. 16, 1999

[54] METHOD FOR INCREASING THE STATIC COEFFICIENT OF FRICTION IN OLEAGINOUS COMPOSITIONS

[75] Inventors: Raymond Frederick Watts, Long Valley; Ricardo Alfredo Bloch, Scotch Plains; Antonio Gutierrez, Mercerville; Roger Keith Nibert, Hampton; Jack Ryer, East Brunswick, all of N.J.

[73] Assignee: Exxon Chemical Patents Inc., Linden, N.J.

[21] Appl. No.: 954,831

[22] Filed: Oct. 21, 1997

Related U.S. Application Data

[63] Continuation of Ser. No. 528,167, Sep. 14, 1995, abandoned, which is a continuation of Ser. No. 170,470, Dec. 20, 1993, abandoned.

[51] Int. Cl.[6] ..... C10M 133/16; C10M 133/56

[52] U.S. Cl. ..... 508/287; 508/293; 508/542; 508/551

[58] Field of Search ..... 508/287, 293

[56] References Cited

U.S. PATENT DOCUMENTS

| | | | |
|---|---|---|---|
| 3,361,673 | 1/1968 | Stuart et al. | 252/51.5 A |
| 3,775,503 | 11/1973 | Driscoll et al. | 252/51.5 A |
| 3,778,487 | 12/1973 | Driscoll et al. | 252/51.5 A |
| 3,793,203 | 2/1974 | Driscoll et al. | 252/56 R |
| 3,809,651 | 5/1974 | Crawford et al. | 252/47.5 |
| 3,873,460 | 3/1975 | Coon et al. | 52/51.5 A |
| 3,879,306 | 4/1975 | Kablaoui et al. | 252/51.5 A |
| 3,920,562 | 11/1975 | Foehr | 252/52 A |
| 3,972,243 | 8/1976 | Driscoll et al. | 74/200 |
| 3,972,941 | 8/1976 | Driscoll et al. | 252/52 R |
| 4,088,586 | 5/1978 | Wilgus et al. | 252/51.5 R |
| 4,094,800 | 6/1978 | Warne | 52/32.7 E |
| 4,101,429 | 7/1978 | Birke | 252/32.7 E |
| 4,152,499 | 5/1979 | Boerzel et al. | 252/51.5 A |
| 4,159,956 | 7/1979 | de Vries | 252/51.5 A |
| 4,253,977 | 3/1981 | O'Halloran | 252/33.4 |
| 4,256,595 | 3/1981 | Sung et al. | 252/51.5 A |
| 4,563,293 | 1/1986 | Small, Jr. | 252/32.7 E |
| 4,629,576 | 12/1986 | Small, Jr. | 252/32.7 E |
| 4,663,063 | 5/1987 | Davis | 252/51.5 R |
| 4,693,838 | 9/1987 | Vaema et al. | 252/51.5 A |
| 4,755,311 | 7/1988 | Burjes et al. | 252/49.9 |
| 4,772,739 | 9/1988 | Forsberg | 558/208 |
| 4,792,410 | 12/1988 | Schwind et al. | 252/38 |
| 4,839,071 | 6/1989 | Gutierrez et al. | 252/51.5 A |
| 4,915,857 | 4/1990 | Emert et al. | 252/51.5 A |
| 4,971,598 | 11/1990 | Andress et al. | 44/57 |
| 4,973,789 | 11/1990 | Karn et al. | 585/525 |
| 5,049,290 | 9/1991 | Emert et al. | 252/51.5 A |
| 5,126,064 | 6/1992 | Barber et al. | 252/47.5 |
| 5,344,579 | 9/1994 | Ohtani et al. | 252/51.5 R |

FOREIGN PATENT DOCUMENTS

| | | | |
|---|---|---|---|
| 0 393 769 A1 | 10/1990 | European Pat. Off. . | |
| 0407124A1 | 1/1991 | European Pat. Off. | C10M 141/10 |
| 0544298A1 | 6/1993 | European Pat. Off. | C10M 163/00 |
| 1087039 | 10/1967 | United Kingdom . | |
| 2257158 | 1/1993 | United Kingdom | C10M 129/04 |
| WO 87/07637 | 12/1987 | WIPO . | |

*Primary Examiner*—Ellen M. McAvoy

[57] ABSTRACT

A method of increasing the static coefficient of friction of an oleaginous composition, such as an ATF, comprising adding to a major portion of an oil of lubricating viscosity a friction increasing amount of an oil soluble friction increasing reaction product comprising (a) an oil soluble substituted or unsubstituted, saturated or unsaturated, branched hydrocarbyl group containing from about 12 to about 50 total carbon atoms, (b) a linking group, and (c) a nitrogen-containing polar group, wherein the polar group contains at least one nitrogen atom and, optionally, contains at least one atom selected from the group consisting of boron, oxygen and sulfur atoms, and wherein the polar group is linked to the branched hydrocarbyl group through the linking group.

7 Claims, No Drawings

METHOD FOR INCREASING THE STATIC COEFFICIENT OF FRICTION IN OLEAGINOUS COMPOSITIONS

This application is a continuation of U.S. Ser. No. 08/528,167 filed Sep. 14, 1995, now abandoned, which is a continuation of U.S. Ser. No. 08/170,470 filed Dec. 20, 1993, now abandoned.

BACKGROUND OF THE INVENTION

1. Field of the Invention

The present invention relates to methods of increasing the static coefficient of friction of oleaginous compositions by adding to such compositions hydrocarbon soluble reaction products consisting of an oil soluble branched hydrocarbyl group, a linking group and a nitrogen containing polar group, which may also contain boron, oxygen or sulfur. These reaction products are useful for increasing the static coefficient of friction of oleaginous compositions, such as lubricating oils, including power transmission fluids, and particularly automatic transmission fluids, in which they are contained.

2. Description of Related Art

Transmission designs have undergone radical changes, thereby necessitating the formulation of ATF additives capable of meeting new and more stringent requirements. One change in transmission design has been the incorporation of lock-up torque converter clutches for improved fuel economy. Another change is the incorporation of 4-wheel drive systems requiring inter-axle differentiating clutches for better driveability. These two devices operate at low sliding speeds and at low energy.

The low speed low energy frictional characteristics of a lubricant are evaluated with a low velocity friction apparatus (LVFA). The LVFA apparatus uses simulated clutches approximately one inch in diameter. These small model clutches are either prepared by the clutch manufacturer to exactly duplicate production parts, or are carefully cut from full size production pieces.

These small test specimens are mounted in the LVFA test chamber and are submerged in test lubricant. An appropriate test load is then applied to the system. The machine is equipped to test at any temperature from 0° C. to 200° C. and once the appropriate temperature has been reached the speed of the clutch is increased from 0 to 500 rpm, and then decreased from 500 to 0 rpm. In this fashion the dependence of friction coefficient on speed and temperature can be determined over a wide range of sliding speeds and temperatures. The initial acceleration of the system from 0 sliding speed also accurately measures breakaway static friction $\mu_s$.

An increasingly important characteristic of an automatic transmission fluid is the level of static breakaway friction that it imparts to the clutch. This parameter, expressed as breakaway static friction or $\mu_s$, reflects the relative tendency of engaged parts, such as clutch packs or bands and drums, to slip under load. If this value is too low, the resulting slippage can impair the driveability and safety of the vehicle. This is especially important in newer cars with smaller transmissions and higher torque engines.

Chemicals which are conventionally referred to as friction modifiers can only lower the value of $\mu_s$. This is not always desirable. Sometimes it is of great benefit to raise the level of $\mu_s$. The products of this invention are true friction increasers, i.e., they increase the value of $\mu_s$, without causing any deleterious effects to the fluid or transmission.

The ability to increase breakaway static friction through the use of chemical additives is extremely valuable. Previously when a transmission manufacturer needed to increase the amount of torque that could be transmitted through a locked clutch they had very few options. Conventionally, increasing the static holding capacity of a clutch has been accomplished by changing the clutch itself, either by increasing the clutch lining area (i.e. using more clutch plates), by changing the clutch lining material or by increasing pressure being applied to the closed clutch. These methods are often undesirable because they necessitate redesigning the transmission. They add weight to the vehicle, cause the transmission to take up more space and make the transmission more costly to produce. Many of these changes can also change the dynamic characteristics of the shift and make it less desirable. The products of this invention make it possible to increase the breakaway static capacity of the system without making any of these changes to the hardware.

Using only conventional friction modifiers (i.e., friction reducers) the only way to increase static friction was to reduce the level of friction reducer. This approach suffers from two problems. First, once all the friction reducer is removed the level of $\mu_s$ cannot be increased further; and second, removing the friction reducer has deleterious effects on the dynamic clutch engagement as well as the friction durability of the fluid.

In the past the only way to increase the coefficient of friction in these systems was to use a "traction fluid". These fluids however are only effective under extremely high loads and require that transmissions be extremely large and heavy to function properly. Due to their unique molecular structure these traction fluids are often very susceptible to oxidation, provide poor wear control and are not easily friction modified to give good dynamic friction characteristics. These fluids are described, for example, in U.S. Pat. Nos. 3,440,894 and 4,008,251.

No base oil alone can even approach the many special properties required for ATF service. Therefore, it is necessary to employ several chemical additives, each of which is designed to impart or improve a specific property of the fluid.

U.S. Pat. No. 4,253,977 relates to an ATF composition which comprises a friction modifier such as n-octadecyl succinic acid or the reaction product of an alkyl or alkenyl succinic anhydride with an aldehyde/tris hydroxymethyl aminomethane adduct and an overbased alkali or alkaline earth metal detergent. The ATF may also contain a conventional hydrocarbyl-substituted succinimide ashless dispersant such as polyisobutenyl succinimide. Other patents which disclose ATF compositions that include conventional alkenyl succinimide dispersants include, for example, U.S. Pat. Nos. 3,879,306; 3,920,562; 3,933,659; 4,010,106; 4,136,043; 4,153,567; 4,159,956; 4,596,663 and 4,857,217; British Patents 1,087,039; 1,474,048 and 2,094,339; European Patent Application 0,208,541(A2); and PCT Application WO 87/07637.

U.S. Pat. No. 3,972,243 discloses traction drive fluids which comprise gem-structured polyisobutylene oligomers. Polar derivatives of such gem-structured polyisobutylenes can be obtained by conversion of the polyisobutylene oligomers to polar compounds containing such functional groups as amine, imine, thioketone, amide, ether, oxime, maleic anhydride, etc. adducts. The polyisobutylene oligomers generally contain from about 16 to about 48 carbon atoms. Example 18 of this patent discloses reacting a polyisobutylene oil with maleic anhydride to form a polyisobutylene succinic anhydride which is useful as a detergent, as an anti-wear agent, and as an intermediate in the production of a hydrazide derivative. Other patents containing similar disclosures include, for example, U.S. Pat. No. 3,972,941; U.S. Pat. No. 3,793,203; U.S. Pat. No. 3,778,487 and U.S. Pat. No. 3,775,503.

While the prior art suggests a variety of additives for modifying the properties of various oleaginous compositions, there is no suggestion of any additives that are suitable for increasing the static breakaway coefficient of friction of such compositions. Accordingly, there is a continuing need for new additives and methods which would enable the formulation of oleaginous compositions, including lubricating oils and power transmission fluids, and particularly automatic transmission fluids, having increased breakaway static coefficient of friction.

SUMMARY OF THE INVENTION

The invention relates to methods for increasing the static coefficient of friction of an oleaginous composition, which comprises:

adding to a major portion of an oil of lubricating viscosity a friction increasing amount of an oil soluble friction increasing reaction product comprising (a) an oil soluble substituted or unsubstituted, saturated or unsaturated, branched hydrocarbyl group containing from about 12 to about 50 total carbon atoms, (b) a linking group, and (c) a nitrogen-containing polar group; said polar group containing at least one nitrogen atom and, optionally, containing at least one atom selected from the group consisting of boron, oxygen and sulfur atoms, and being linked to said hydrocarbyl group through said linking group.

DETAILED DESCRIPTION OF THE INVENTION

The hydrocarbon soluble friction increasing reaction products contemplated for use with this invention comprise a branched chain hydrocarbyl group which is linked to a nitrogen-containing polar group. The friction increasing reaction products may be represented by the formula I:

$$A - L - P \qquad (I)$$

wherein A represents the branched hydrocarbyl group; L represents the linking group; and P represents the nitrogen-containing polar group.

The branched hydrocarbyl group A typically contains from about 12 to about 50 carbon atoms and has a molecular weight on the order of from about 150 to about 700. In preferred embodiments, however, the molecular weight of the hydrocarbyl group ranges from about 350 to about 600, and most preferably from about 400 to about 500.

Suitable branched hydrocarbyl groups include alkyl, alkenyl, aryl, cycloalkyl, and hetero atom-containing analogs thereof.

The hetero atom-containing branched hydrocarbyl groups may contain one or more hetero atoms. A variety of hetero atoms can be used and are readily apparent to those skilled in the art. Suitable hetero atoms include, but are not limited to, nitrogen, oxygen, phosphorus, and sulfur. Preferred hetero atoms are sulfur and oxygen.

In one preferred embodiment, the branched hydrocarbyl group may be represented by formula II:

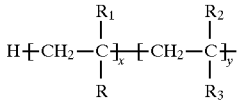

(II)

wherein R represents a linear or branched $C_1$ to $C_{12}$ hydrocarbyl group, such as an alkyl, alkenyl, aryl alkaryl, aralkyl or cycloalkyl group or hetero-containing analog thereof; wherein $R_1$, $R_2$ and $R_3$, which can be the same or different, independently represent H or a linear or branch $C_1$ to $C_{12}$ hydrocarbyl group, as defined above; x represents an integer from 1 to about 17; and y represents zero or an integer of from 1 to about 10; and wherein the total number of carbon atoms in the branched hydrocarbyl group is from about 12 to about 50, typically from about 25 to about 45, and preferably from about 28 to about 36.

A preferred branched hydrocarbyl group is branched alkenyl, preferably derived from an olefin polymer. The olefin polymer may comprise a homopolymer of an olefin monomer having 3 to about 12, preferably 3 to 6, carbon atoms, or a copolymer of olefin monomers containing 2 to about 12, preferably 2 to 6, carbon atoms. Suitable copolymers include random, block and tapered copolymers, provided that such copolymers possess a branched structure.

Suitable monomers include, for example, ethylene, propylene, isobutylene, pentene, 2-methyl pentene, hexene, 2-ethyl hexene, and diolefins such as butadiene and isoprene, provided that the resulting homopolymers or copolymer are branched. While selection of monomers suitable for preparing branched homopolymers or copolymers is readily apparent to those skilled in the art, it is preferred to use a branched hydrocarbyl group derived from propylene, for example, tetrapropylene, or from isobutylene, for example, polyisobutylene having a number average molecular weight of from about 150 to about 700, preferably from about 350 to about 600, and most preferably from about 400 to about 500.

Linking Group

In one embodiment, the linking group which may be reacted with the branched hydrocarbyl group and with the polar group typically is derived from a monounsaturated carboxylic reactant comprising at least one member selected from the group consisting of (i) monounsaturated $C_4$ to $C_{10}$ dicarboxylic acid wherein (a) the carboxyl groups are vicinyl, (i.e. located on adjacent carbon atoms) and (b) at least one, preferably both, of said adjacent carbon atoms is part of said monounsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon—carbon double bond is allylic to the carboxy group, i.e., of the structure

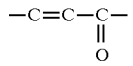

and (iv) derivatives of (iii) such as $C_1$ to $C_5$ alcohol derived mono- or diesters of (iii). Upon reaction with the branched hydrocarbyl group reactant, the monounsaturation of the carboxylic reactant becomes saturated. Thus, for example, maleic anhydride becomes a branched hydrocarbyl group substituted succinic anhydride, and acrylic acid becomes a branched hydrocarbyl substituted propionic acid.

Exemplary of such monounsaturated carboxylic reactants are fumaric acid, itaconic acid, itaconic anhydride, maleic acid, maleic anhydride, chloromaleic acid, chloromaleic anhydride, acrylic acid, methacrylic acid, crotonic acid, hemic anhydride, cinnamic acid, and lower alkyl (e.g., $C_1$ to $C_4$ alkyl) acid esters of the foregoing, e.g., methyl maleate, ethyl fumarate, methyl fumarate, etc.

Maleic anhydride or a derivative thereof is preferred as it does not homopolymerize appreciably, but attaches onto the branched hydrocarbyl group to give two carboxylic acid functionalities. Such preferred materials have the generic formula III:

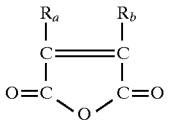

(III)

wherein $R_a$ and $R_b$ are hydrogen or a halogen.

In an alternative embodiment, the linking group may comprise the residue of a functionalized aromatic compound, such as a phenol or a benzene sulfonic acid. Thus, in one preferred aspect of the invention, the linking group may be illustrated by formula IV:

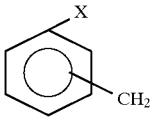

(IV)

wherein X is a functional group such as OH, Cl or $SO_3H$.

In such cases, the subject friction increasers may be prepared, for example, by a conventional Mannich Base condensation of aldehyde, (e.g., formaldehyde), polar group precursor (e.g. alkylene polyamine) and branched hydrocarbyl group substituted phenol. The following U.S. patents contain extensive disclosures relative to the production of Mannich condensates: U.S. Pat. Nos. 2,459,112; 2,962,442; 3,355,270; 3,448,047; 3,600,372, 3,649,729 and 4,100,082.

Sulfur-containing Mannich condensates also may be used and such condensates are described, for example, in U.S. Pat. Nos. 3,368,972; 3,649,229; 3,600,372; 3,649,659 and 3,741,896. Generally, the condensates useful in this invention are those made from a phenol having a branched hydrocarbyl substituent of about 12 to about 50 carbon atoms, more typically, 25 to about 45 carbon atoms. Typically these condensates are made from formaldehyde or a $C_2$ to $C_7$ aliphatic aldehyde and an amino compound.

These Mannich condensates are prepared by reacting about one molar portion of hydrocarbyl substituted phenolic compound with about 1 to about 2.5 molar portions of aldehyde and about 1 to about 5 equivalent portions of amino compound (an equivalent of amino compound is its molecular weight divided by the number of NH groups present). The conditions under which the condensation reactions are carried out are well known to those skilled in the art as evidenced by the above-noted patents. Accordingly, the above-noted patents are incorporated by reference for their disclosures relating to reaction conditions.

Polar Group

The polar group comprises the residue of an amine compound, i.e. polar group precursor, containing at least 1, typically 2 to 60, and preferably 2 to 40 total carbon atoms, and at least 1, typically 2 to 15, and preferably 2 to 9 nitrogen atoms, with at least one nitrogen atom preferably being present in a primary or secondary amine group. The amine compounds may be hydrocarbyl amines or may be hydrocarbyl amines including other groups, e.g., hydroxy groups, alkoxy groups, amide groups, nitrile groups, imidazole groups, morpholine groups or the like. The amine compounds also may contain 1 or more boron or sulfur atoms, provided that such atoms do not interfere with the substantially polar nature and function of the selected polyamine.

Useful amines include those of formulas V and VI:

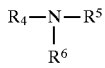

(V)

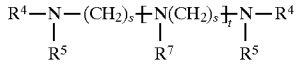

(VI)

wherein $R^4$, $R^5$, $R^6$ and $R^7$ are independently selected from the group consisting of hydrogen, $C_1$ to $C_{25}$ linear or branched alkyl radicals, $C_1$ to $C_{12}$ alkoxy $C_2$ to $C_6$ alkylene radicals, $C_2$ to $C_{12}$ hydroxy amino alkylene radicals, and $C_1$ to $C_{12}$ alkylamino $C_2$ to $C_6$ alkylene radicals; and wherein $R^7$ can additionally comprise a moiety of the formula:

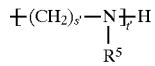

wherein $R^5$ is defined above; wherein s and s' can be the same or a different number of from 2 to 6, preferably 2 to 4; and t and t' can be the same or a different number of from 0 to 10, preferably 0 to 7 with the proviso that the sum of t and t' is not greater than 15.

Non-limiting examples of suitable amine compounds include: 1,2-diaminoethane, 1,6-diaminohexane; polyethylene amines such as diethylene pentamine; polypropylene amines such as 1,2-propylene diamine; di-(1,2-propylene diamine; di-(1,2-propylene)triamine; di-(1,3-propylene) triamine; N,N-dimethyl-1,3-diaminopropane; N,N-di(2-aminoethyl) ethylene diamine; N,N-di(2-hydroxyethyl)1,3-propylene diamine; 1-hydroxy-3-dimethylamino propane; 1-hydroxy-3-dimethylamino propane; 3-dodecyloxypropylamine; N-dodecyl-1,3-propane diamine; etc.

Other suitable amines include: amino morpholines such as N-(3-aminopropyl) morpholine and N-(2-aminoethyl) morpholine; substituted pyridines such as 2-amino pyridine, 2-methylamino pyridine and 2-methylamino pyridine; and others such as 2-aminothiazole; 2-amino pyrimidine; 2-amino benzothiazole; methyl-1-phenyl hydrazine and para-morpholino aniline, etc. A preferred group of aminomorpholines are those of formula VII:

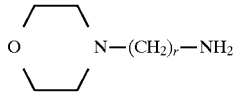

(VII)

where r is a number having a value of 1 to 5.

Useful amines also include alicyclic diamines, imidazolines and N-aminoalkyl piperazines of formula VIII:

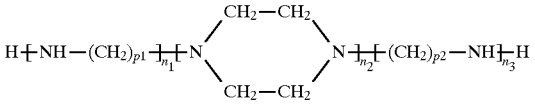

(VIII)

wherein $p_1$ and $p_2$ are the same or different and each is an integer of from 1 to 4; and $n_1$, $n_2$ and $n_3$ are the same or different and each is an integer of from 1 to 3.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those having formula IX:

$$NH_2\text{-alkylene-O-alkylene}_m\text{-}NH_2, \quad (IX)$$

wherein m has a value of at least 3 and "alkylene" represents a linear or branched chain $C_2$ to $C_7$, preferably $C_2$ to $C_4$ alkylene radical; or formula X:

$$R^8\text{-(alkylene-(O-alkylene)}_{m'}\text{-}NH_2)_a, \quad (X)$$

wherein $R_8$ is a polyvalent saturated hydrocarbon radical having up to 10 carbon atoms and the number of substituents on the $R^8$ group is represented by the value of "a", which is a number of from 3 to 6, wherein m' has a value of at least 1; and wherein "alkylene" represents a linear or branched chain $C_2$ to $C_7$, preferably $C_2$ to $C_4$ alkylene radical.

The polyoxyalkylene polyamines of formulas (IX) or (X) above, preferably polyoxyalkylene diamines and polyoxyalkylene triamines, may have average molecular weights ranging from about 200 to about 4000 and preferably from about 400 to about 2000. The preferred polyoxyalkylene polyamines include the polyoxyethylene and polyoxypropylene triamines. The polyoxyalkylene polyamines are commercially available and may be obtained, for example, from the Jefferson Chemical Company, Inc. under the trade name "Jeffamines D-230, D-400, D-1000, D-2000, T-403", etc.

The polar group may be joined to the linking group through an ester linkage when the linking group is a carboxylic acid or anhydride. To incorporate polar groups of this type they must have one free hydroxyl group and all nitrogens must be tertiary nitrogen atoms. Polar groups of this type are represented by formula XI:

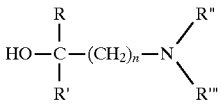

(XI)

wherein n has a value of 1 to 10, R and R' are H or $C_1$ to $C_{12}$ alkyl, and R" and R'" are $C_1$ to $C_6$ alkyl.

Forming the Friction Increasers

In accordance with one aspect of the invention, the branched hydrocarbyl group precursor (e.g., polyisobutylene) may be reacted with or grafted to the linking group precursor (e.g. monounsaturated carboxylic reactant), preferably in solution in a diluent oil.

Typically, from about 0.7 to about 4.0 (e.g., 0.8 to 2.6), preferably from about 1.0 to about 2.0, and most preferably from about 1.1 to about 1.7 moles of said monounsaturated carboxylic reactant are charged to the reactor per mole of branched hydrocarbyl group precursor.

Normally, not all of the hydrocarbyl group precursor reacts with the monounsaturated carboxylic reactant and the reaction mixture will contain unreacted hydrocarbyl material. The unreacted hydrocarbyl material is typically not removed from the reaction mixture (because such removal is difficult and would be commercially infeasible) and the product mixture, stripped of any monounsaturated carboxylic reactant is employed for further reaction with the polar group precursor as described hereinafter to make the friction increaser.

Characterization of the average number of moles of monounsaturated carboxylic reactant which have reacted per mole of hydrocarbyl material changed to the reaction (whether it has undergone reaction or not) is defined herein as functionality. Said functionality is based upon (i) determination of the saponification number of the resulting product mixture using potassium hydroxide; and (ii) the number average molecular weight of the polymer charged, using techniques well known in the art. Functionality is defined solely with reference to the resulting product mixture. Although the amount of the reacted hydrocarbyl material contained in the resulting product mixture can be subsequently modified, i.e., increased or decreased by techniques known in the art, such modifications do not alter functionality as defined above.

Typically, the functionality of the branched hydrocarbyl substituted mono- and dicarboxylic acid material is at least about 0.5, preferably at least about 0.8, and most preferably at least about 0.9 and will vary typically from about 0.5 to about 2.8 (e.g., 0.6 to 2), preferably from about 0.8 to about 1.4 and most preferably from about 0.9 to about 1.3.

The branched hydrocarbyl reactant can be reacted with the monounsaturated carboxylic reactant by a variety of methods. For example, the hydrocarbyl reactant can be first halogenated, e.g., chlorinated or brominated, to about 1 to 8 wt. % preferably 3 to 7 wt. % chlorine, or bromine, based on the weight of hydrocarbyl reactant, by passing the chlorine or bromine through the hydrocarbyl reactant at a temperature of 60° to 150° C., preferably 110° to 160° C., e.g., 120° C., for about 0.5 to 10, preferably 1 to 7 hours. The halogenated hydrocarbyl reactant may then be reacted with sufficient monounsaturated carboxylic reactant at 100° to 150° C., usually about 180° to 235° C., for about 0.5 to 10, e.g., 3 to 8 hours, so the product obtained will contain the desired number of moles of the monounsaturated carboxylic reactant per mole of the halogenated hydrocarbyl reactant. Processes of this general type are taught in U.S. Pat. Nos. 3,087,436; 3,172,892; 3,272,746 and others. Alternatively, the hydrocarbyl reactant and the monounsaturated carboxylic reactant may be mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

Alternatively, the hydrocarbyl group may be grafted onto the monounsaturated carboxylic reactant using free radical initiators such as peroxides and hydroperoxides, preferably those which have a boiling point greater than about 100° C. and which decompose thermally within the grafting temperature range to provide said free radicals. Representative of these free-radical initiators are azobutyronitrile, 2,5-dimethyl-hex-3-yne-2,5-bis-tertiary-butyl peroxide (sold as Lupersol 130) or its hexane analogue, ditertiary butyl peroxide and dicumyl peroxide. The initiator is generally used at a level of between about 0.005% and about 1%, based on the total weight of the reaction mixture, and at a temperature of about 25° to 220° C., preferably 150°–200° C.

The unsaturated carboxylic acid material, preferably maleic anhydride, generally will be used in an amount ranging from about 0.05% to about 10%, preferably 0.1 to 2.0%, based on weight of the reaction mixture. The carboxylic acid material and free radical initiator generally are used in a weight percent ratio range of 3.0:1 to 30.1; preferably 1.0:1 to 6.0:1.

The initiator grafting preferably is carried out in an inert atmosphere, such as that obtained by nitrogen blanketing. While the grafting can be carried out in the presence of air, the yield of the desired grafted product is generally thereby decreased as compared to grafting under an inert atmosphere substantially free of oxygen. The grafting time usually will range from about 0.05 to 12 hours, preferably from about 0.1 to 6 hours, more preferably 0.5 to 3 hours. The graft reaction usually will be carried out to at least approximately 4 times, preferably at least about 6 times the half life of the free-radical initiator at the reaction temperature employed, e.g., with 2,5-dimethyl-hex-3-yne-2,5-bis(t-butyl peroxide) 2 hours at 160° C. and one hour 170° C., etc.

In the grafting process, usually the hydrocarbyl material to be grafted, is dissolved in the liquid synthetic oil (normally liquid at 21.1° C.(70° F.)) by heating to form a solution and thereafter the unsaturated carboxylic acid material and initiator are added with agitation, although they could have been added prior to heating. When the reaction is complete, the excess acid may be eliminated by an inert gas purge, e.g., nitrogen sparging. Preferably any carboxylic acid material that is added is kept below its solubility limit. For example, maleic anhydride is kept below about 1 wt. %, preferably below 0.4 wt. % or less, of free maleic anhydride based on the total weight of solution. Continuous or periodic addition of the carboxylic acid material along with an appropriate portion of initiator, during the course of the reaction, can be utilized to maintain the carboxylic acid below its solubility limits, while still obtaining the desired degree of total grafting.

The reaction product of the branched hydrocarbyl group precursor and the linking group precursor may be further reacted with a polar group precursor (e.g., alkylene polyamine) without isolating the reaction product from the diluent oil and without any prior treatment. In the alternative, the reaction product may be concentrated or diluted further by the addition of mineral oil of lubricating viscosity to facilitate the reaction with the polar group precursor.

The branched hydrocarbyl-substituted linking agent reaction product in solution in the synthetic oil, e.g., polymeric hydrocarbon or alkylbenzene, typically at a concentration of about 5 to 50 wt. %, preferably 10 to 30 wt. % reaction product, can be readily reacted with a polar group precursor, i.e., amine compound by heating at a temperature of from about 100° C. to 250° C., preferably from 120° to 230° C., for from about 0.5 to 10 hours, usually about 1 to about 6 hours. The heating is preferably carried out to favor formation of imides and amides. Reaction ratios can vary considerably, depending upon the reactions, amounts of excess, type of bonds formed, etc.

Typically, the polar group precursor amine compounds will be used in the range of 0.1 to 10 wt. %, preferably 0.5 to 5 wt. %, based on the weight of the hydrocarbyl-substituted linking group. The amine compound is preferably used in an amount that neutralizes the acid moieties by formation of amides, imides or salts.

Preferably the amount of amine compound used is such that there is 1 to 2 moles of amine reacted per equivalent mole of carboxylic acid. For example, with a polyisobutylene polymer of 450 number average molecular weight, grafted with an average of 1 maleic anhydride group per molecule, preferably about 1 to 2 molecules of amine compound is used per molecule of grafted polyisobutylene polymer.

Alternatively, as discussed above, the polar group precursor may be reacted with an aldehyde and a hydrocarbyl substituted phenol in a conventional manner to form Mannich condensates having friction increasing properties.

Compositions

A minor amount, e.g., 0.01 up to about 50 wt. %, preferably 0.1 to 10 wt. %, and more preferably 0.5 to 5 wt. %, of the friction increaser products produced in accordance with this invention can be incorporated into a major amount of an oleaginous material, such as a lubricating oil, depending upon whether one is forming finished products or additive concentrates. When used in lubricating oil compositions, e.g., automatic transmission formulations, etc. the final friction increaser concentrations are usually within the range of about 0.01 to 20 wt. %, e.g., 0.1 to 10 wt. %, preferably 0.5 to 5.0 wt. %, of the total composition. The lubricating oils to which the products of this invention can be added include not only hydrocarbon oil derived from petroleum, but also include synthetic lubricating oils such as esters of dicarboxylic acids; complex esters made by esterification of monocarboxylic acids, polyglycols, dicarboxylic acids and alcohols; polyolefin oils, etc.

The friction increaser products of the invention may be utilized in a concentrate form, e.g., in a minor amount from about 0.1 wt. % up to about 50 wt. %, preferably 5 to 25 wt. %, in a major amount of oil, e.g., said synthetic lubricating oil with or without additional mineral lubricating oil.

The above oil compositions may contain other conventional additives, such as ashless dispersants, for example the reaction product of polyisobutylene succinic anhydride with polyethyleneamines of 2 to 10 nitrogens, which reaction product may be borated; antiwear agents such as zinc dialkyl dithiophosphates; viscosity index improvers such as polyisobutylene, polymethacrylates, copolymers of vinyl acetate and alkyl fumarates, copolymers of methacrylates with amino methacrylates; corrosion inhibitors; oxidation inhibitors; friction modifiers; metal detergents such as overbased calcium magnesium sulfonates, phenate sulfides, etc.

The following examples, wherein all parts or percentages are by weight unless otherwise noted, which include preferred embodiments, further illustrate the present invention.

PREPARATIVE EXAMPLES

EXAMPLE 1

Polyisobutenyl succinic anhydride (PIBSA) having a succinic anhydride (SA) to polyisobutylene (PIB) ratio (SA:PIB), i.e., functionality, of about 1, was prepared by gradually heating a mixture of 170 kg (280 lbs.) of PIB having a number average molecular weight (Mn) of 450 with approximately 27.7 kg (61 lbs.) of maleic anhydride to a temperature of approximately 120° C. Chlorine gas was then bubbled through the mixture at approximately 2.7 kg (6 lbs.) per hour. The reaction mixture was then heated to approximately 160°–170° C. and was maintained at that temperature until a total of approximately 22.9 kg (50.5 lbs.) of chlorine was added. The reaction mixture was then heated to approximately 220° C. and sparged with nitrogen to remove unreacted maleic anhydride. The resulting polyisobutenyl succinic anhydride had an ASTM Saponification Number (SAP) of 176 and an active ingredient level of 88%, which calculates to a SA to PIB ratio of about 1.0 based upon the starting PIB.

The PIBSA product was aminated by charging to a reactor approximately 36.3 kg (80 lbs.) of the PIBSA; approximately 6.0 kg (13.1 lbs.) of a commercial grade of polyethylene amine which was a mixture of polyethylene amines averaging about 5 to 7 nitrogen per molecule (PAM); 13.7 kg (30.2 lbs.) of a solvent 150 neutral oil (Exxon S150N); and 5.5 grams of a 50% mixture of a silicone-based antifoamant in a hydrocarbon solvent. The mixture was heated to 150° C., and a nitrogen sparge started to drive off water. The mixture was maintained at 150° C. for 2 hours when no further water was evolving. The product was cooled and drained from the reactor to give the final product (PIBSA-PAM) having a PIBSA to PAM ratio (PIBSA:PAM) of about 2.2:1 (using 232 as the molecular weight of PAM).

EXAMPLES 2–7

The procedure of EXAMPLE 1 was repeated except that, as noted in Table 1, the PIB starting material and/or the amount and identity of the amine reactant were changed. Also, in EXAMPLE 4, the PIBSA-PAM product prepared in EXAMPLE 1 was borated by adding 1000 grams of the PIBSA-PAM product to a stirred reactor, whereafter the temperature was raised to 130° C., a nitrogen sweep was begun, and 168.7 g of a 30% slurry of boric acid (50.6 g boric acid) was added portion wise over 2 hours. The reaction mixture was held at 130° C. for an additional hour, cooled and filtered. The resulting borated PIBSA/PAM contained 0.79% boron.

TABLE 1

| EXAMPLE NO. | MW OF PIB | AMINE | RATIO SA:AMINE | BORATED |
|---|---|---|---|---|
| 1 | 450 | PAM[1] | 2.2:1 | NO |
| 2 | 450 | PAM | 3.0:1 | NO |
| 3 | 450 | DIMAP[2] | 1.0:1 | NO |
| 4 | 450 | PAM | 2.2:1 | YES |
| 5 | 200 | DETA[3] | 2.0:1 | NO |
| 6 | 200 | DIMAP | 1.0:1 | NO |
| 7 | 450 | NAPM[4] | 1.0:1 | NO |

[1]$C_2$ based alkylene polyamine
[2]dimethylaminopropylamine
[3]diethylene triamine
[4]3-aminopropylmorpholine

EXAMPLE 8

To a 2 liter 4-necked reaction flask equipped with a stirrer, Dean Stark trap, condenser and nitrogen sparger were charged dodecylphenol (524 g, 2.0 m), trioxane (60 g, 0.66 m) and tetraethylene pentamine (TEPA) (189 g, 1.0 m). The temperature was raised slowly to 110° C. at which time water evolution began. After 8 hours the temperature had risen to 115° C. and water evolution ceased (42 cc's of water were collected). The mixture was cooled and filtered to yield 730g of a dodecylphenol-TEPA product containing 9.1% nitrogen.

EXAMPLE 9–12

The amount of carboxylic acid (or anhydride) indicated in Table 2 was placed in a round bottom flask equipped with a stirrer, Dean Stark trap, condenser and nitrogen sparger. The acid (or anhydride) was heated to 180° C. +/− 10° C. and the indicated amount of tetraethylene pentamine (TEPA) was added through a dropping funnel over a 1 to 2 hour period with a constant nitrogen sparge. Evolved water was collected in the Dean Stark Trap. After water evolution ceased, the mixture was cooled and filtered to give the desired product.

TABLE 2

| EXAMPLE NO. | ALKYL PORTION | AMINE | RATIO ACID:AMINE | BORATED |
|---|---|---|---|---|
| 9 | DDSA[5] 133 g (0.5 m) | TEPA[6] 42.25 g (0.22 m) | 2.2:1 | 171 g, 9.4% N |
| 10(comparative) | Oleic acid 282 g (1.0 m) | TEPA 73 g (0.39 m) | 3.1:1 | 341 g, 6.6% N |
| 11(comparative) | Isostearic acid 248 g (1.0 m) | TEPA 73 g (0.39 m) | 3.1:1 | 351 g, 6.4% N |
| 12(comparative) | OSA[7] 175 g (0.25 m) | TEPA 47.3 g (0.25 m) | 2.0:1 | 222.5 g, 4.0% N |

[5]dodecyl succinic anhydride; dodecyl is branched hydrocarbyl, i.e., tetrapropylene.
[6]TEPA is tetraethylene pentamine.
[7]octadecenyl succinic anhydride; octadecenyl is linear hydrocarbyl.

Standard automatic transmission fluids (ATF's) were prepared for testing the friction characteristics of the reaction products formed in EXAMPLES 1–12. The fluids were prepared by blending the indicated reaction product into an additive concentrate, and then dissolving the concentrate into a mineral oil base fluid (Exxon FN 1391) to give the required concentration of additives. The basic test blend contained approximately 10 weight % of additives including dispersant, anti-wear agent, corrosion inhibitor, antioxidant, viscosity modifier, and the indicated amount of the reaction product of EXAMPLES 1–12 (the "CONTROL" did not contain any of said reaction products).

The various ATF's were tested using a low velocity friction apparatus (LVFA), to determine the effect on the static breakaway friction coefficient ($\mu_s$) of the indicated reaction products (and the CONTROL). The test procedure was as follows:

Test Specimens:

Clutch friction material with a machined annulus of 28.6 mm (1.125 inch) O.D., 22.2 mm (0.875 inch) I.D., and mean diameter 25.4 mm (1.00 inch) was adhesively bonded to a steel backing disc. SAE 1035 steel discs of 38.1 mm (1.50 inch) diameter were stamped from separator steel stock and tumble finished to 0.25–0.38 $\mu$m (10–15 micro-inch) A. A surface roughness finish.

Test Procedure:

After ultrasonically cleaning the steel specimens and test machine fixtures in heptane, the specimens were assembled in the tester and surfaces broken-in for one hour at a given test load (483 (70), 965 (140) or 1448 kPa (210 psi)) at a sliding speed of 0.25 m/s (50 ft/min), at ambient temperature with 100 cc of test fluid. X-Y plots of coefficient of friction versus sliding speed, from 0–0.51 m/s (0–100 ft/min), were then recorded at 93° C. and at 149° C. Friction was measured by a dead weight calibrated load cell. Heating of the fluid was accomplished by imbedded cartridge heaters. Coefficient of friction data reported were the average of the plots obtained during acceleration to 0.51 m/s (100 ft/min) and then deceleration back to rest. Static friction was measured after deceleration and was the average of four measurements.

The results of the tests, which are set forth in Table 3 below, indicate that oleic acid-TEPA (Comparative EXAMPLE 10), isostearic acid-TEPA (comparative EXAMPLE 11) and OSA-TEPA (comparative EXAMPLE 12), all of which contain essentially linear hydrocarbyl groups linked to an amine polar group, acted as conventional friction modifiers, i.e., they all caused a significant decrease in the static coefficient of friction $\mu_s$ (relative to the CONTROL) at 93° C. and at 149° C.

The test results also indicate that all of the reaction products of EXAMPLES 1–8 (which contain a branched hydrocarbyl group linked to a polar group in accordance with the invention) caused an increase in $\mu_s$ (relative to the Control) at 93° C., with the products of EXAMPLES 3, 6 and 8 causing very significant increases. The results also show substantial increases $\mu_s$ at 149° C. for the products of EXAMPLES 2–6 and 8, particularly the product of EXAMPLE 8.

EXAMPLES 13–17

A series of standard ATF's was prepared in the manner described above, except that the concentration of the friction increaser was systematically varied to determine the effect of friction increaser concentration on $\mu_s$. Table 4 shows the ATF's that were prepared and their static coefficients of friction as measured by LVFA. The data in Table 4 demonstrates that increasing the friction increaser concentration resulted in an increase in $\mu_s$. At 93° C., a maximum value for $\mu_s$ was reached when the concentration of friction increaser was about 2.5 wt. %, whereas the value for $\mu_s$ at 149° C. continued to increase when the concentration of friction increaser was increased to 5 wt. %.

TABLE 3

| EXAMPLE NO. | ADDITIVE | CONCENTRATION WT. % | LVFA, $\mu_s$ AT 93° C. | LVFA, $\mu_s$ AT 149° C. |
|---|---|---|---|---|
| 1 | 450 MW PIBSA-PAM | 1.00 | 0.187 | 0.163 |
| 2 | 450 MW PIBSA-PAM | 1.00 | 0.188 | 0.154 |
| 3 | 450 MW PIBSA-DIMAP | 1.00 | 0.207 | 0.157 |
| 4 | 450 MW PIBSA-PAM (BORATED) | 1.00 | 0.197 | 0.162 |
| 5 | 200 MW PIBSA -DETA | 1.00 | 0.194 | 0.147 |
| 6 | 200 MW PIBSA -DIMAP | 1.00 | 0.210 | 0.170 |
| 7 | 450 MW PIBSA -NAPM | 1.00 | 0.193 | 0.138 |
| 8 | Dodecylphenol -TEPA | 1.00 | 0.257 | 0.218 |
| 10 | Oleic acid -TEPA | 1.00 | 0.040 | 0.036 |
| 11 | Isostearic acid-TEPA | 1.00 | 0.069 | 0.049 |
| 12 | OSA-TEPA | 1.00 | 0.068 | 0.056 |
| CONTROL | — | 0.00 | 0.170 | 0.138 |

TABLE 4

| EXAMPLE NO. | FRICTION INCREASER | RATIO SA:AMINE | CONC., wt. % | LVFA, $\mu_s$ AT 93° C. | LVFA, $\mu_s$ AT 149° C. |
|---|---|---|---|---|---|
| CONTROL | NONE | — | 0.00 | 0.170 | 0.138 |
| 13 | 450 MW PIBSA-PAM | 2.2:1 | 0.25 | 0.188 | 0.149 |
| 14 | 450 MW PIBSA-PAM | 2.2:1 | 0.50 | 0.189 | 0.163 |
| 15 | 450 MW PIBSA-PAM | 2.2:1 | 1.00 | 0.200 | 0.171 |
| 16 | 450 MW PIBSA-PAM | 2.2:1 | 2.50 | 0.207 | 0.186 |
| 17 | 450 MW PIBSA-PAM | 2.2:1 | 5.00 | 0.207 | 0.190 |

EXAMPLES 18–24

Another series of standard ATF's was prepared in the manner described above, except that in this series, the molecular weight of the branched hydrocarbyl group of the friction increaser additive was systematically varied while the concentration of friction increaser additive was maintained at 1.00 wt. % in all cases. Table 5 shows the compositions of the various friction modifier additives and the static coefficients of friction as determined by LVFA for each ATF in this series. The data in Table 5 shows that the 200 MW PIBSA-PAM was not soluble in the ATF and, therefore, could not be used as a friction increaser in accordance with this invention. The data also shows that the friction increasing effect, both at 93° C. and at 149° C., decreased relative to the CONTROL when the molecular weight of the branched hydrocarbyl group increased from 200 to about 900. At 149° C. the rate of decrease in $\mu_s$ was more rapid such that both 900 MW PIBSA-DIMAP and 900 MW PIBSA-PAM actually functioned as conventional friction modifying agents (i.e. friction reducing agents). The data in Table 5 shows excellent friction increase, both at 93° C. and at 149° C., for the ATF's containing 450 MW PIBSA-PAM (both borated and non-borated) and 450 MW PIBSA-DIMAP.

TABLE 5

| EXAMPLE NO. | FRICTION INCREASER | RATIO SA:AMINE | CONC., wt. % | LVFA, $\mu_s$ AT 93° C. | LVFA, $\mu_s$ AT 149° C. |
|---|---|---|---|---|---|
| CONTROL | NONE | — | 0.00 | 0.170 | 0.138 |
| 18 | 200 MW PIBSA-DIMAP | 1.0:1 | 1.00 | 0.210 | 0.170 |
| 19 | 450 MW PIBSA-DIMAP | 1.0:1 | 1.00 | 0.207 | 0.156 |
| 20 | 900 MW PIBSA-DIMAP | 1.0:1 | 1.00 | 0.183 | 0.135 |
| 21 | 200 MW PIBSA-PAM | 2.0:1 | NOT SOLUBLE | | |
| 22 | 450 MW PIBSA-PAM | 2.2:1 | 1.00 | 0.187 | 0.163 |
| 23 | 450 MW PIBSA-PAM (Borated) | 2.2:1 | 1.00 | 0.195 | 0.166 |
| 24 | 900 MW PIBSA-PAM | 2.6:1 | 1.00 | 0.175 | 0.130 |

EXAMPLES 25–28

Another series of standard ATF's was prepared in the manner described above, except that in this series dodecyl (i.e., propylene tetramer) succinic anhydride (DDSA) was used as the branched hydrocarbyl substituted linking group, with the polyamine (i.e., polar group) being varied. Table 6 shows the composition of the various friction increasers, as well as the static friction at 93° C. and at 149° C. by LVFA. The data in Table 6 shows that a maximum effectiveness as a friction increaser is reached when the polar group contains more amino nitrogen (i.e. the use of tetraethylene pentamine (TEPA) as the polar group resulted in a higher $\mu_s$, at 93° C. and the same $\mu_s$ at 149° C. when compared to the use of triethylene tetramine (TETA), whereas the use of triethylene tetramine resulted in a higher $\mu_s$, both at 93° C. and at 149° C., than did the use of diethylene triamine (DETA)). In all cases, $\mu_s$ for ATF's containing the friction increasers of this invention were higher than $\mu_s$ for the CONTROL.

TABLE 6

| EXAMPLE NO. | FRICTION IN CREASER | RATIO ACID:AMINE | CONC., wt. % | LVFA, $\mu_s$ AT 93° C. | LVFA, $\mu_s$ AT 149° C. |
|---|---|---|---|---|---|
| CONTROL | NONE | — | 0.00 | 0.165 | 0.115 |
| 25 | DDSA-DETA | 2.0:1 | 1.00 | 0.172 | 0.119 |
| 26 | DDSA-TETA | 2.0:1 | 1.00 | 0.198 | 0.148 |
| 27 | DDSA-TEPA | 2.0:1 | 1.00 | 0.199 | 0.148 |
| 28 | DDSA-DETA | 2.3:1 | 1.00 | 0.170 | 0.127 |

What is claimed:

1. A method of increasing the static coefficient of friction of an oleaginous composition, which comprises:

adding to a major portion of an oil of lubricating viscosity a friction increasing amount of an oil soluble friction increasing reaction product comprising (a) a polyisobutenyl moiety having a number average molecular weight of from about 400 to about 500, (b) a linking group L comprising the residue of a member selected from the group consisting of (i) monounsaturated $C_4$ to $C_{10}$ dicarboxylic acid wherein (1) the carboxyl groups are vicinyl, and (2) at least one of said adjacent carbon atoms is part of said monounsaturation; (ii) derivatives of (i); (iii) monounsaturated $C_3$ to $C_{10}$ monocarboxylic acid wherein the carbon—carbon double bond is allylic to the carboxy group; (iv) derivatives of (iii); and (v) methylene substituted aromatic materials having the formula

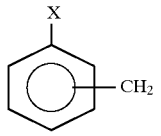

where X is a functional group selected from the group consisting of OH, Cl and $SO_3H$, and (c) a nitrogen-containing polar group; said polar group containing at least one nitrogen atom and, optionally, containing at least one atom selected from the group consisting of boron, oxygen and sulfur atoms, and being linked to said hydrocarbyl group through said linking group.

2. The method of claim 1, wherein said polar group comprises the residue of a polyamine containing from 2 to about 60 total carbon atoms and from 2 to about 15 nitrogen atoms, wherein at least 1 of said nitrogen atoms is present in a primary or secondary amino group.

3. A method of increasing the static friction coefficient of a lubricating oil composition, which comprises adding to a major portion of an oil of lubricating viscosity a friction increasing effective amount of a friction increaser comprising the reaction product of (a) polyamine having from 2 to about 15 nitrogen atoms, at least 1 of which is a primary or secondary amino nitrogen, and from about 2 to about 60 carbon atoms with (b) a member selected from the group consisting of (i) a $C_4$ to $C_{10}$ dicarboxylic acid, anhydride or ester, substituted by a polyisobutenyl moiety having a number average molecular weight of from about 400 to about 500 (ii) a $C_3$ to $C_{10}$ monocarboxylic acid, anhydride or ester, substituted by a polyisobutenyl moiety having a number average molecular weight of from about 400 to about 500 and (iii) an aromatic compound of the formula:

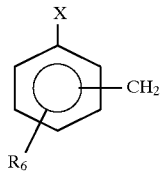

wherein $R_6$ represents a polyisobutenyl moiety substituent having a number average molecular weight of from about 400 to about 500, and X represents a functional group selected from the group consisting of OH, Cl and $SO_3H$.

4. A friction increasing compound having the formula: A - L - P, wherein

A represents a polyisobutenyl moiety having a number average molecular weight of from about 400 to about 500;

L represents a linking group comprising the residue of a member selected from the group consisting of:

(i) a monounsaturated $C_4$ to $C_{10}$ dicarboxylic acid wherein the carboxyl groups are vicinyl and at least one of said adjacent carbon atoms is part of said monounsaturation;

(ii) derivatives of (i);

(iii) a monounsaturated C3 to $C_{10}$ monocarboxylic acid wherein the carbon—carbon double bond is allylic to the carboxy group;

(iv) derivatives of (iii); and (v) methylene substituted aromatic materials having the formula:

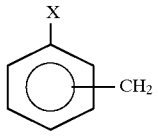

where X is a functional group selected from the group consisting of OH, Cl and $SO_3H$; and P represents a nitrogen-containing polar group containing at least one nitrogen atom and, optionally, containing at least one atom selected from the group consisting of boron, oxygen and sulfur atoms.

5. The compound according to claim 4, wherein A has the formula:

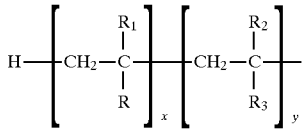

where R is a $C_1$ to $C_{12}$ hydrocarbyl group, optionally substituted with non-interfering heteroatoms;

$R_1$, $R_2$, and $R_3$, independently, are H or $C_1$ to $C_{12}$ hydrocarbyl, optionally substituted with non-interfering heteroatoms;

x is 1 to 17; and y is 0 to 10.

6. The compound according to claim 4, wherein the polar group P comprises the residue of a polyamine containing from 2 to about 60 total carbon atoms and from 2 to about 15 nitrogen atoms, wherein at least 1 of said nitrogen atoms is present in a primary or secondary amino group.

7. A friction increasing compound comprising the reaction product of (a) a polyamine having from 2 to about 15 nitrogen atoms, at least 1 of which is a primary or secondary amino nitrogen, and from about 2 to about 60 carbon atoms with (b) a member selected from the group consisting of (i) a $C_4$ to $C_{10}$ dicarboxylic acid, anhydride or ester, substituted by a polyisobutenyl moiety having a number average molecular weight of from about 400 to about 500 (ii) $C_3$ to $C_{10}$ monocarboxylic acid, anhydride or ester, substituted by a polyisobutenyl moiety having a number average molecular weight of from about 400 to about 500 and (iii) an aromatic compound of the formula:

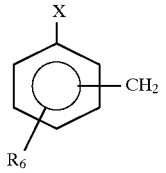

wherein $R_6$ represents a polyisobutenyl moiety substituent having a number average molecular weight of from about 400 to about 500, and X represents a functional group selected from the group consisting of OH, Cl and $SO_3H$.

* * * * *